United States Patent [19]

Ishikawa et al.

[11] Patent Number: 4,942,377

[45] Date of Patent: Jul. 17, 1990

[54] ROD TYPE DIELECTRIC RESONATING DEVICE WITH COUPLING PLATES

[75] Inventors: Youhei Ishikawa; Kikuo Tsunoda; Toshiro Hiratsuka; Hirotsugu Abe, all of Kyoto, Japan

[73] Assignee: Murata Manufacturing Co., Ltd., Japan

[21] Appl. No.: 197,693

[22] Filed: May 23, 1988

[30] Foreign Application Priority Data

May 29, 1987 [JP] Japan ..... 62-85099[U]
May 30, 1987 [JP] Japan ..... 62-137500
May 30, 1987 [JP] Japan ..... 62-137501

[51] Int. Cl.[5] ..... H01P 1/20; H01P 7/10

[52] U.S. Cl. ..... 333/202; 333/219.1; 333/234

[58] Field of Search ..... 333/219.1, 219, 234, 333/230, 212, 202

[56] References Cited

U.S. PATENT DOCUMENTS 4,318,064 3/1982 Kach ..... 333/219.1 X
4,423,397 12/1983 Nishikawa et al. ..... 333/219.1
4,639,699 1/1987 Nishikawa et al. ..... 333/219.1 X

FOREIGN PATENT DOCUMENTS 38996 11/1981 European Pat. Off. ..... 333/202
162103 9/1983 Japan ..... 333/202
208301 9/1986 Japan ..... 333/202
61-50401 11/1986 Japan .

*Primary Examiner*—Eugene R. Laroche
*Assistant Examiner*—Benny Lee
*Attorney, Agent, or Firm*—Ostrolenk, Faber, Gerb & Soffen

[57] ABSTRACT

A dielectric resonating device comprises a conductive case, a bar-shaped dielectric resonator body located in the case, exciting means for exciting the dielectric resonator body, and at least one plate located between the case and the dielectric resonator body, forming at least two resonators of said device. An inner peripheral end of the plate is fixed to the dielectric resonator body. An outer peripheral end of the plate is located to face the case and define therewith a gap for coupling adjustment between the two resonators.

The exciting means has electrodes connected to both ends of the dielectric resonator body, and input and output connectors fixed to the electrodes. The electrodes each have the shape of a flat plate and they are located with a gap between them and the case.

19 Claims, 3 Drawing Sheets

ROD TYPE DIELECTRIC RESONATING DEVICE WITH COUPLING PLATES

BACKGROUND OF THE INVENTION

FIELD OF THE INVENTION

The present invention relates to a dielectric resonating device and particularly to a dielectric resonating device having therein a plurality of transverse magnetic (TM) dielectric resonators which together constitute a bandpass filter.

In a dielectric resonating device, an oscillation mode of a dielectric resonator fixed in a shield case and sectioned by a metallic plate is known to be the $TM_{010}$ mode as indicated for example in Japanese Patent Publication No. 50401/1986.

In a conventional dielectric resonating device, a dielectric resonator body 2 is positioned in a cylindrical case 1 as shown in FIG. 1. A plate 3 of a disc shape is fixed on the inner wall of the cylindrical case 1, forming two resonators. The dielectric resonator body 2 penetrates a hole formed in the plate 3 and a gap 4 is defined between the dielectric resonator body 2 and the plate 3 for coupling between the two resonators.

In the above described structure of the conventional device, a high dimensional precision is required in the gap 4 for adjustment of a coupling coefficient because the coupling gap 4 is formed in a region exposed to a high field strength, close to the dielectric resonator body 2. Accordingly, it is difficult to obtain a desired coupling coefficient. In addition, in order to maintain a stable state in the gap 4 with respect to temperature change, the cylindrical case 1 and the plate 3 need to be formed by a material having the same coefficient of linear expansion as that of the dielectric resonator body 1. If a stable coupling coefficient is to be obtained for that reason, the range of materials that can be used considerably limited.

In the device of FIG. 1, input/output connectors 5 are fixed to both ends of the cylindrical case 1. Internal conductors 6 of the connectors 5 are fitted fixedly in holes 8 formed in both ends of the dielectric resonator body 2 through holes 7 of the cylindrical case 1, whereby the connectors 5 and the dielectric resonator body 2 are connected.

Since the internal conductors 6 are hidden in the respective holes 8 in the above described structure, it becomes difficult to adjust a coupling condition between an external circuit and the resonator once the internal conductors are fitted fixedly in the holes 8.

SUMMARY OF THE INVENTION

An object of the present invention is to provide a dielectric resonating device which overcomes the above described difficulties and makes it easy to adjust the coupling coefficient.

Another object of the present invention is to provide a dielectric resonating device, which exhibits an excellent temperature characteristic even if no special material is used for the outer case and which can be manufactured easily.

Still another object of the present invention is to provide a dielectric resonating device, which can be manufactured at low cost with uniformly high quality.

According to a first aspect of the present invention, a dielectric resonating device comprises: a conductive case, a bar-shaped dielectric resonator body provided in the case, exciting means for exciting the dielectric resonator body, and a at least one plate provided between the case and the dielectric resonator body, forming at least two resonators. An inner peripheral end of the plate is fixed to the dielectric resonator body. An outer peripheral end of the plate is located to face the inner wall of the case and define therewith a gap for coupling adjustment between the two resonators.

Preferably, a thin silver film of a predetermined width is formed by a baking process on a portion of the dielectric resonator body to allow fixation of the plate, and the plate is fixed on the thin silver film with silver paste.

In the above described device, a coupling coefficient is defined by the gap between the outer peripheral end of the plate and the case. Since this gap is provided in a region exposed to a relatively low field strength near the case and not near the dielectric resonator body, the coupling coefficient is little changed even if some dimensional error exists in the gap. Consequently, it is not necessary to form the gap for coupling adjustment with such high precision as in the case of a conventional device. In addition, since change in the coupling coefficient is little when the gap for coupling adjustment is changed to some extent, it is not necessary to take account of expansion due to temperature change in the plate or the case and thus the materials usable for the case and the plate are less limited.

In fixing the plate to the dielectric resonator by applying silver paste to the thin silver film on the resonator body, the area of the adhesion of the silver to the dielectric resonator body is not varied even if the silver paste is applied with an irregularly curved border. Accordingly, no irregularity is caused in distribution of the magnetic field in the device and the coupling condition between the resonator body and the plate is constantly determined.

According to a second aspect of the present invention, a dielectric resonating device comprises: a conductive case, a bar-shaped dielectric resonator body provided in the case, electrodes fixed to both ends of the dielectric resonator body, and input and output connectors fixed to the electrodes. The electrodes each have a shape of a flat plate and they are located with a gap between each of them and the case.

When a voltage of a given frequency band is applied from the input connector, the dielectric body is excited and an output is obtained from the output connector. The degree of coupling between an external circuit and the resonator is dependent on the gap between each electrode and the case. Accordingly, the degree of coupling is set by a method in which the shape and the size of each electrode is appropriately selected so that the gap between each electrode and the case is changed to a desired value. Even after the electrodes and the input and output connectors are coupled, it is easy to finely adjust the degree of coupling between the electrodes and the case by shaving the flat plates of the electrodes or attaching silver paste to the electrodes.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
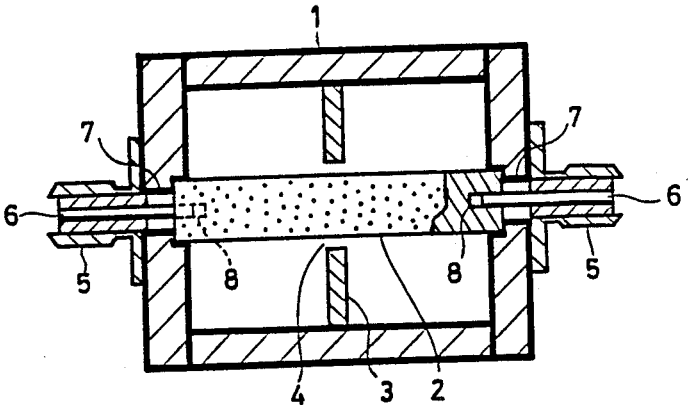
FIG. 1 PRIOR ART
FIG. 1 is a cross sectional view of a conventional device.
Figure 2:
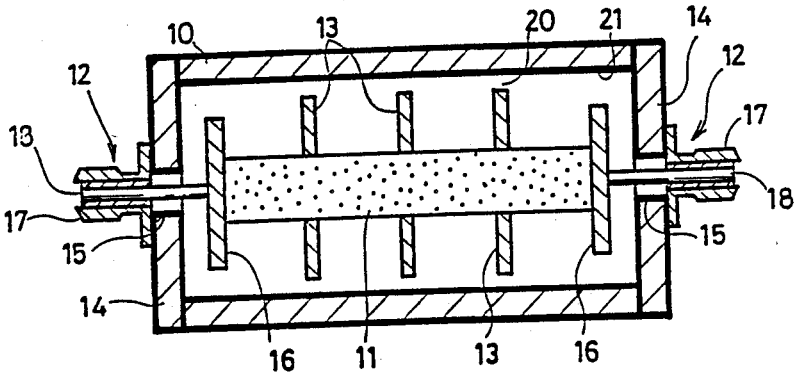
FIG. 2 is a cross sectional view of an embodiment of the present invention.

FIG. 2 shows an example in which a dielectric resonating device in accordance with the present invention is applied to form a bandpass filter. In FIG. 2, the $TM_{010}$ mode dielectric resonating device comprises a cylindrical case 10, a cylindrical dielectric resonator body 11 of a high frequency ceramic material located in the case 10 coaxially therewith, external coupling means 12, and coupling plates 13.

The case 10 is a cylindrical body formed of a material having the same coefficient of linear expansion as that of the resonator body 11 and coated with a metallic film, as indicated by the heavy outlines defining the case in FIG. 2, or a cylindrical body of metal.

Both ends of the cylindrical body are closed by end plates 14 each formed by a disc of a material having the same coefficient of linear expansion as that of the resonator body 11 and coated with a metallic film, again as indicated by the heavy outlines, or formed by a metallic plate. Each of the end plates 14 has a hole 15 in the center. The size of the hole 15 is determined to ensure a cut-off state therein with respect to the mode applied to the device.

Figure 3:
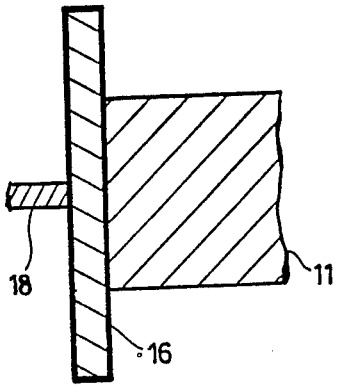
FIG. 3 is a partial enlarged view of the embodiment of FIG. 2.

Each of the external coupling means 12 comprises an electrode 16 fixed to an end of the resonator body 11 and having for example a diameter larger than that of the resonator body 11, a coaxial connector 17 fixed to the end plate 14, and an antenna conductor rod 18 connected to a central pin of the coaxial connector 17 or formed integrally with the central pin. Each antenna conductor rod 18 extends through the corresponding hole 15 into the case 10 and an end thereof is fixed electrically and mechanically to the center of the corresponding electrode 16 as shown in FIG. 3. Thus, the dielectric resonator body 11 is located in the case 10 coaxially.

Each of the coupling plates 13 is a disc member and has a hole in the center into which the dielectric resonator body 11 is fitted.

Figure 4:
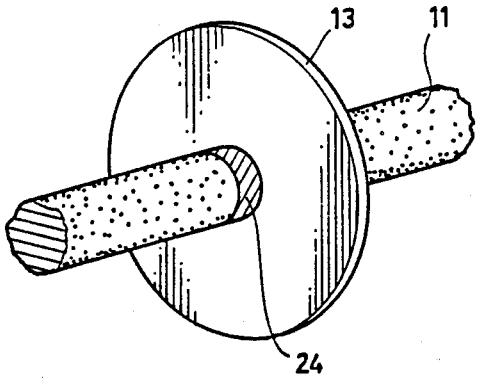
FIG. 4 is a partial perspective view showing a state in which a plate is fixed.
Figure 6:
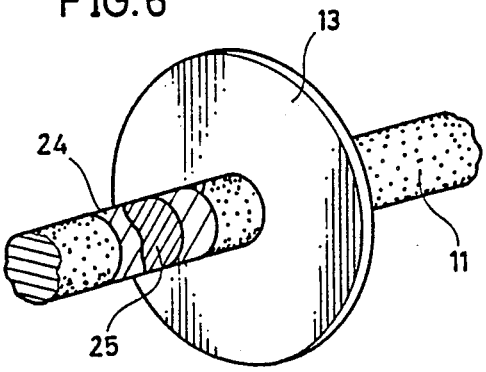
Figure 8:
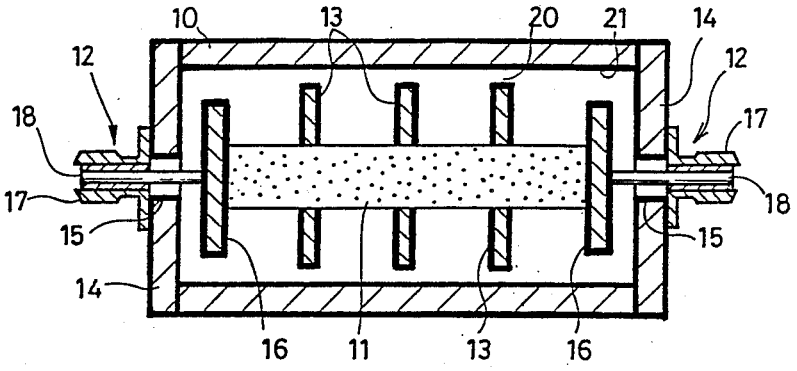
FIG. 8 is a view similar to FIG. 2, showing in addition an example of a silver coating on the ceramic plates 13 and on the electrodes 16.

In the embodiment of FIG. 2, three plates 13 are attached onto the dielectric resonator body 11 at equal intervals, forming four resonators. Each plate 13 has a structure formed of a metal or a ceramic on which a silver film is coated by baking, as indicated by the heavy outlines defining the plates in FIG. 8. As shown in FIG. 4, a thin silver film 24 is coated by baking on an external surface of the dielectric resonator body 11. The thin silver film 24 is coated to have a predetermined width larger than the thickness of the plate 13 at a position on the resonator body 11 where the plate 13 is to be fixed. The plate 13 is fixed on the thin silver film 24 with silver paste 25 applied in a necessary amount (as shown in FIG. 6). An outer diameter of each plate 13 is set to a value a little smaller than an inner diameter of the case 10 and thus a gap 20 for coupling between the resonators defined on either side of the plate 13 is formed between the case and each plate 13 (see FIG. 2).

The ceramic of the electrodes 16 and the plates 13 has the same coefficient of linear expansion (including substantially the same value) as that of the dielectric resonator body 11. In addition, a gap 21 is formed between each electrode 16 and the case 10, so that the degree of coupling between an external circuit and the resonator body 11 is also dependent on the magnitude of the gap 21 (see FIG. 2).

Now, operation of this embodiment will be described.

When an input signal is applied to one of the coaxial connectors 17, an output of a predetermined bandwidth is obtained through the other coaxial connector 17. It is considered that coupling between the external circuit and the resonator body 11 involves electric field coupling between the electrodes 16 and the resonator body 11 and magnetic field coupling between the antenna conductor rods 18 and the resonator body 11.

Determination or change of the coupling coefficient between the external circuit and the resonator can be made in an arbitrary manner by changing the thickness of the plates 13 and the gap 20 between the plates 13 and the case 10. In such adjustment, the gap 20 between the plates 13 and the case 10 does not need to be provided with high precision because the gap 20 is located in a region exposed to a lower field strength near the case 10. In addition, since the coupling coefficient is changed to a smaller extent, the case 10 does not need to be formed of a material having the same coefficient of linear expansion as that of the dielectric resonator body 11 and the plates 13. For example, easily processable metals can be used arbitrarily, which makes it possible to reduce the manufacturing costs.

Since the electrodes 16 are spaced apart from the case 10 by the gaps 21, they have a stable characteristic with respect to temperature changes. The gap 21 between each electrode 16 and the case 10 can be easily changed by changing the shape of each electrode 16. By the change of the gap 21, the degree of coupling can be changed.

The change in the degree of coupling as a result of the changes in the gaps 20 and 21 can be made not only by alterations in design of the plates or the electrodes; the degree of coupling can be finely adjusted if the surfaces of the plates 13 or the electrodes 16 are slightly shaved or a necessary amount of silver paste is adhered thereto.

Figure 5:
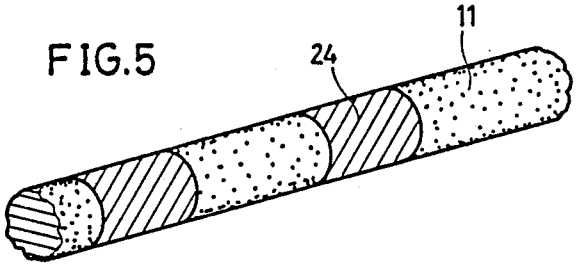
FIGS. 5 and 6 are partial perspective views showing steps of fixing a plate.

In fixing the plates to the dielectric resonator body 11, first the resonator body 11 having its external surface coated with thin silver films 24 is prepared as shown in FIG. 5. Each plate 13 is fitted on a thin silver film 24 of the resonator body 11 and is fixed by means of silver paste 25 as shown in FIG. 6. Even if the silver paste 25 extends beyond the predetermined area corresponding to the thickness of the plate 13 when the plate 13 is fixed to the dielectric resonator body 11, the area of adhesion of the silver to the dielectric resonator body 11 is not changed since the excess of the silver paste 25 exists on the thin silver film 24. Accordingly, work of fixation between the dielectric resonator body 11 and the plate 13 can be effected efficiently and the device finished has a fine appearance. In addition, since the degree of coupling can be adjusted by change of the width of the thin silver film 24 coated on the dielectric resonator body 11 without requiring any change in the thickness of the plate 13 or the size of the gap, the manufacturing cost of the device can be reduced.

In the following, other embodiments will be briefly described.

(a) Although the three plates 13 are used in the embodiment of FIG. 2, the present invention is applicable irrespective of the number of plates 13.

Figure 7:
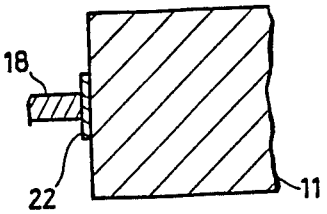
FIG. 7 is a partial enlarged view of another embodiment of the present invention, which corresponds to FIG. 3.

(b) Electrodes simply formed of a metallic plate may be adopted in place of the electrodes 16 formed as described above. The size of such electrodes is not limited to having a larger diameter than that of the dielectric resonator 11. As shown in FIG. 7, each of such electrodes may also comprise an electrode film 22 having a smaller diameter than that of the dielectric resonator body 11.

(c) Although the above described embodiment comprises the cylindrical dielectric resonating device, the present invention is also applicable to a device comprising a dielectric resonator in the shape of a square bar, for example.

Although embodiments of the present invention have been described and illustrated in detail, it is clearly understood that the same is by way of illustration and example only and is not to be taken by way of limitation, the scope of the present invention being limited only by the terms of the appended claims.

We claim:

1. A dielectric resonating device, comprising:

a conductive case;

a bar-shaped dielectric resonator body located within the case;

exciting means adjacent said resonator body for exciting the dielectric resonator body; and at least one plate located extending between the case and the dielectric resonator body, which segments the dielectric resonator body into at least one pair of resonating segments within said case on either side of said at least one plate, a radially inner portion of said at least one plate being fixed to said dielectric resonator body, and an outer periphery of said at least one plate being disposed at a location facing said case to define a gap for coupling adjustment between said pair of resonating segments.

2. A dielectric resonating device in accordance with claim 1, further comprising a thin silver film of a predetermined width coated on an area of said dielectric resonator body where said plate is to be fixed, and silver paste on said thin silver film by which said plate is fixed on said thin silver film to said dielectric resonator body.

3. A dielectric resonating device in accordance with claim 2, wherein said plate is formed of a metal.

4. A dielectric resonating device in accordance with claim 2, wherein said plate is formed of ceramic on which silver is coated.

5. A dielectric resonating device in accordance with claim 4, wherein the ceramic of said plate has a coefficient of linear expansion substantially equal to a coefficient of linear expansion of the dielectric resonator body.

6. A dielectric resonating device in accordance with claim 5, wherein said case is formed of a material having a coefficient of linear expansion equal to said coefficient of linear expansion of said resonator body and a metallic film covers all surfaces of said case.

7. A dielectric resonating device in accordance with claim 6, wherein said device is operable in the $TM_{010}$ mode.

8. A dielectric resonating device in accordance with claim 7, wherein said pair of resonators within said device together form a bandpass filter.

9. A dielectric resonating device in accordance with claim 1, further comprising a second plate located extending between the case and the dielectric resonator body;

said second plate which segments the dielectric resonator body into a third resonating segment within said case on a side of said second plate away from said at least one plate;

a radially inner portion of said second plate being fixed to said dielectric resonator body; and an outer periphery of said plate being disposed at a location facing said case to define a gap for coupling adjustment between said resonating segments on either side of said second plate.

10. A dielectric resonator device in accordance with claim 9, wherein said at least three resonators together form a bandpass filter.

11. A dielectric resonating device, comprising:

an elongated conductive case having longitudinal ends;

a single bar-shaped dielectric resonator body located within the case and having two ends which are respectively adjacent the longitudinal ends of said case;

electrodes fixed to both ends of the dielectric resonator body; and respective input and output connectors electrically connected to the electrodes and electrically communicating said electrodes with the exterior of said case, said electrodes each having a shape of a flat plate and being disposed at a location to define a gap between said electrode and said case.

12. A dielectric resonating device, comprising:

a conductive case;

a bar-shaped dielectric resonator body located within the case and having two ends within said case;

electrodes fixed to both ends of the dielectric resonator body; and respective input and output connectors electrically connected to the electrodes and electrically communicating said electrodes with the exterior of said case, said electrodes each having a shape of a flat plate and being disposed at a location to define a gap between said electrode and said case;

wherein said electrodes have a coefficient of linear expansion substantially equal to a coefficient of linear expansion of said dielectric resonator body.

13. A dielectric resonating device in accordance with claim 12, wherein said resonator body is substantially circular in cross-section, and each said electrode is substantially circular and has a diameter larger than that of said dielectric resonator body.

14. A dielectric resonating device in accordance with claim 13, wherein said case is formed of a material having a coefficient of linear expansion substantially equal to said coefficient of linear expansion of said dielectric resonator body and a metallic film covering all surfaces of said case.

15. A dielectric resonating device in accordance with claim 14, further comprising at least one plate located extending between said case and said dielectric resonator body, which segments the dielectric resonator body into at least a pair of resonating segments within said case on either side of said at least one plate, a radially inner portion of said at least one plate being fixed to said dielectric resonator body, and an outer periphery of said at least one plate being disposed at a location facing said case to define a gap for coupling adjustment between said pair of resonating segments.

16. A dielectric resonating device in accordance with claim 15, wherein said device is operable in the $TM_{010}$ mode.

17. A dielectric resonating device in accordance with claim 16, wherein said pair of resonators within said device together form a bandpass filter.

18. A dielectric resonating device in accordance with claim 15, further comprising a second plate located extending between the case and the dielectric resonator body;

said second plate which segments the dielectric resonator body into a third resonating segment within said case on a side of said second plate away from said at least one plate;

a radially inner portion of said second plate being fixed to said dielectric resonator body; and an outer periphery of said plate being disposed at a location facing said case to define a gap for coupling adjustment between said resonating segments on either side of said second plate.

19. A dielectric resonator device in accordance with claim 18, wherein said at least three resonators together form a bandpass filter.

* * * * *